US007357644B2

(12) United States Patent
Dittmann

(10) Patent No.: US 7,357,644 B2
(45) Date of Patent: Apr. 15, 2008

(54) CONNECTOR HAVING STAGGERED CONTACT ARCHITECTURE FOR ENHANCED WORKING RANGE

(75) Inventor: Larry E. Dittmann, Middletown, PA (US)

(73) Assignee: Neoconix, Inc., Sunnyvale, CA (US)

( * ) Notice: Subject to any disclaimer, the term of this patent is extended or adjusted under 35 U.S.C. 154(b) by 0 days.

(21) Appl. No.: 11/298,570

(22) Filed: Dec. 12, 2005

(65) Prior Publication Data

US 2007/0134949 A1 Jun. 14, 2007

(51) Int. Cl.
*H01R 12/00* (2006.01)

(52) U.S. Cl. ..... 439/66; 439/862

(58) Field of Classification Search ..... 439/66, 439/591, 862

See application file for complete search history.

(56) References Cited

U.S. PATENT DOCUMENTS

| | | | |
|---|---|---|---|
| 3,543,587 | A | 12/1970 | Kawada |
| 3,634,807 | A | 1/1972 | Grobe et al. |
| 3,670,409 | A | 6/1972 | Reimer |
| 4,087,146 | A | 5/1978 | Hudson, Jr. |
| 4,175,810 | A | 11/1979 | Holt et al. |
| 4,548,451 | A | 10/1985 | Benarr et al. |
| 4,592,617 | A | 6/1986 | Seidler |
| 4,657,336 | A | 4/1987 | Johnson et al. |
| 4,893,172 | A | 1/1990 | Matsumoto et al. |
| 4,998,885 | A | 3/1991 | Beaman |
| 5,053,083 | A | 10/1991 | Sinton |
| 5,135,403 | A | 8/1992 | Rinaldi |
| 5,148,266 | A | 9/1992 | Khandros et al. |
| 5,152,695 | A | 10/1992 | Grabbe et al. |
| 5,161,983 | A | 11/1992 | Ohno et al. |
| 5,173,055 | A | 12/1992 | Grabbe |
| 5,199,879 | A | 4/1993 | Kohn et al. |
| 5,228,861 | A | 7/1993 | Grabbe |
| 5,257,950 | A | 11/1993 | Lenker et al. |
| 5,292,558 | A | 3/1994 | Heller et al. |

(Continued)

FOREIGN PATENT DOCUMENTS

EP 1280241 A1 1/2003

(Continued)

OTHER PUBLICATIONS

Kromann, Gary B., et al., "Motorola's PowerPC 603 and PowerPC 604 RISC Microprocessor: the C4/Cermanic-ball-grid Array Interconnect Technology", *Motorola Advanced Packaging Technology,* Motorola Inc.,(1996),1-10 Pgs.

(Continued)

*Primary Examiner*—Tho D. Ta
(74) *Attorney, Agent, or Firm*—D. Curtis Hogue, Jr.; Hogue Intellectual Property

(57) ABSTRACT

An architecture for increasing the normalized working range of connectors having arrays of small contacts. One configuration includes a plurality of pairs of opposed contacts that are arranged in a staggered fashion. The opposed contacts are configured to engage an external contact array in a staggered fashion. The contact arm length of elastic contacts can be substantially greater than the effective array pitch of the plurality of pairs of opposed contacts. Accordingly, the vertical displacement range of three dimensional contacts formed in the connector can be much greater than for in-line contact arrangements.

19 Claims, 13 Drawing Sheets

U.S. PATENT DOCUMENTS

| | | | | |
|---|---|---|---|---|
| 5,299,939 | A | 4/1994 | Walker et al. | |
| 5,338,209 | A | 8/1994 | Brooks et al. | |
| 5,358,411 | A | 10/1994 | Mroczkowski et al. | |
| 5,366,380 | A | 11/1994 | Reymond | |
| 5,380,210 | A | 1/1995 | Grabbe et al. | |
| 5,468,655 | A | 11/1995 | Greer | |
| 5,483,741 | A | 1/1996 | Akram et al. | |
| 5,509,814 | A | 4/1996 | Mosquera | |
| 5,528,456 | A | 6/1996 | Takahashi | |
| 5,530,288 | A | 6/1996 | Stone | |
| 5,532,612 | A | 7/1996 | Liang | |
| 5,575,662 | A | 11/1996 | Yamamoto et al. | |
| 5,590,460 | A | 1/1997 | DiStefano et al. | |
| 5,593,903 | A | 1/1997 | Beckenbaugh et al. | |
| 5,629,837 | A | 5/1997 | Barabi et al. | |
| 5,632,631 | A | 5/1997 | Fjelstad et al. | |
| 5,751,556 | A | 5/1998 | Butler et al. | |
| 5,772,451 | A | 6/1998 | Dozier, II et al. | |
| 5,791,911 | A | 8/1998 | Fasano et al. | |
| 5,802,699 | A | 9/1998 | Fjelstad et al. | |
| 5,812,378 | A | 9/1998 | Fjelstad et al. | |
| 5,842,273 | A | 12/1998 | Schar | |
| 5,860,585 | A | 1/1999 | Rutledge et al. | |
| 5,896,038 | A | 4/1999 | Budnaitis et al. | |
| 5,903,059 | A | 5/1999 | Bertin et al. | |
| 5,934,914 | A | 8/1999 | Fjelstad et al. | |
| 5,956,575 | A | 9/1999 | Bertin et al. | |
| 5,967,797 | A | 10/1999 | Maldonado | |
| 5,980,335 | A | 11/1999 | Barbieri et al. | |
| 5,989,994 | A | 11/1999 | Khoury et al. | |
| 5,993,247 | A | 11/1999 | Kidd | |
| 6,000,280 | A | 12/1999 | Miller et al. | |
| 6,019,611 | A | 2/2000 | McHugh et al. | |
| 6,029,344 | A | 2/2000 | Khandros et al. | |
| 6,031,282 | A | 2/2000 | Jones et al. | |
| 6,032,356 | A | 3/2000 | Eldridge et al. | |
| 6,042,387 | A | 3/2000 | Jonaidi | |
| 6,044,548 | A | 4/2000 | Distefano et al. | |
| 6,063,640 | A | 5/2000 | Mizukoshi et al. | |
| 6,072,323 | A | 6/2000 | Hembree et al. | |
| 6,083,837 | A | 7/2000 | Millet | |
| 6,084,312 | A | 7/2000 | Lee | |
| 6,133,534 | A | 10/2000 | Fukutomi et al. | |
| 6,142,789 | A | 11/2000 | Nolan et al. | |
| 6,146,151 | A | 11/2000 | Li | |
| 6,156,484 | A | 12/2000 | Bassous et al. | |
| 6,181,144 | B1 | 1/2001 | Hembree et al. | |
| 6,184,699 | B1 | 2/2001 | Smith et al. | |
| 6,191,368 | B1 * | 2/2001 | Di Stefano et al. | 174/260 |
| 6,196,852 | B1 | 3/2001 | Neumann et al. | |
| 6,200,143 | B1 | 3/2001 | Haba et al. | |
| 6,204,065 | B1 | 3/2001 | Ochiai | |
| 6,205,660 | B1 | 3/2001 | Fjelstad et al. | |
| 6,208,157 | B1 | 3/2001 | Akram et al. | |
| 6,218,848 | B1 | 4/2001 | Hembree et al. | |
| 6,220,869 | B1 | 4/2001 | Grant et al. | |
| 6,221,750 | B1 | 4/2001 | Fjelstad | |
| 6,224,392 | B1 | 5/2001 | Fasano et al. | |
| 6,250,933 | B1 | 6/2001 | Khoury et al. | |
| 6,255,727 | B1 | 7/2001 | Khoury | |
| 6,255,736 | B1 | 7/2001 | Kaneko | |
| 6,263,566 | B1 | 7/2001 | Hembree et al. | |
| 6,264,477 | B1 | 7/2001 | Smith et al. | |
| 6,293,806 | B1 | 9/2001 | Yu | |
| 6,293,808 | B1 | 9/2001 | Ochiai | |
| 6,297,164 | B1 | 10/2001 | Khoury et al. | |
| 6,298,552 | B1 | 10/2001 | Li | |
| 6,300,782 | B1 | 10/2001 | Hembree et al. | |
| 6,306,752 | B1 | 10/2001 | DiStefano et al. | |
| 6,335,210 | B1 | 1/2002 | Farooq et al. | |
| 6,336,269 | B1 | 1/2002 | Eldridge et al. | |
| 6,337,575 | B1 | 1/2002 | Akram | |
| 6,352,436 | B1 | 3/2002 | Howard | |
| 6,361,328 | B1 | 3/2002 | Gosselin | |
| 6,373,267 | B1 | 4/2002 | Hiroi | |
| 6,374,487 | B1 | 4/2002 | Haba et al. | |
| 6,375,474 | B1 * | 4/2002 | Harper et al. | 439/66 |
| 6,384,475 | B1 * | 5/2002 | Beroz et al. | 257/690 |
| 6,392,524 | B1 | 5/2002 | Biegelsen et al. | |
| 6,392,534 | B1 | 5/2002 | Flick | |
| 6,397,460 | B1 | 6/2002 | Hembree | |
| 6,399,900 | B1 | 6/2002 | Khoury et al. | |
| 6,402,526 | B1 | 6/2002 | Schreiber et al. | |
| 6,409,521 | B1 | 6/2002 | Rathburn | |
| 6,420,661 | B1 | 7/2002 | Di Stefano et al. | |
| 6,420,789 | B1 | 7/2002 | Tay et al. | |
| 6,420,884 | B1 | 7/2002 | Khoury et al. | |
| 6,428,328 | B2 | 8/2002 | Haba et al. | |
| 6,436,802 | B1 | 8/2002 | Khoury | |
| 6,437,591 | B1 | 8/2002 | Farnworth et al. | |
| 6,442,039 | B1 | 8/2002 | Schreiber | |
| 6,452,407 | B2 | 9/2002 | Khoury et al. | |
| 6,461,892 | B2 | 10/2002 | Beroz | |
| 6,465,748 | B2 | 10/2002 | Yamanashi et al. | |
| 6,472,890 | B2 | 10/2002 | Khoury et al. | |
| 6,474,997 | B1 | 11/2002 | Ochiai | |
| 6,492,251 | B1 | 12/2002 | Haba et al. | |
| 6,497,581 | B2 * | 12/2002 | Slocum et al. | 439/66 |
| 6,517,362 | B2 | 2/2003 | Hirai et al. | |
| 6,520,778 | B1 | 2/2003 | Eldridge et al. | |
| 6,524,115 | B1 | 2/2003 | Gates et al. | |
| 6,551,112 | B1 | 4/2003 | Li et al. | |
| 6,576,485 | B2 | 6/2003 | Zhou et al. | |
| 6,604,950 | B2 | 8/2003 | Maldonado et al. | |
| 6,612,861 | B2 | 9/2003 | Khoury et al. | |
| 6,616,966 | B2 | 9/2003 | Mathieu et al. | |
| 6,622,380 | B1 | 9/2003 | Grigg | |
| 6,627,092 | B2 | 9/2003 | Clements et al. | |
| 6,640,432 | B1 | 11/2003 | Mathieu et al. | |
| 6,661,247 | B2 | 12/2003 | Maruyama et al. | |
| 6,663,399 | B2 | 12/2003 | Ali et al. | |
| 6,664,131 | B2 | 12/2003 | Jackson | |
| 6,669,489 | B1 | 12/2003 | Dozier, II et al. | |
| 6,671,947 | B2 | 1/2004 | Bohr | |
| 6,677,245 | B2 | 1/2004 | Zhou et al. | |
| 6,692,263 | B2 | 2/2004 | Villain et al. | |
| 6,692,265 | B2 | 2/2004 | Kung et al. | |
| 6,700,072 | B2 | 3/2004 | Distefano et al. | |
| 6,701,612 | B2 | 3/2004 | Khandros et al. | |
| 6,719,569 | B2 | 4/2004 | Ochiai | |
| 6,730,134 | B2 | 5/2004 | Neidich | |
| 6,736,665 | B2 | 5/2004 | Zhou et al. | |
| 6,750,136 | B2 | 6/2004 | Zhou et al. | |
| 6,750,551 | B1 | 6/2004 | Frutschy et al. | |
| 6,763,581 | B2 | 7/2004 | Hirai et al. | |
| 6,791,171 | B2 | 9/2004 | Mok et al. | |
| 6,814,584 | B2 | 11/2004 | Zaderej | |
| 6,814,587 | B2 | 11/2004 | Ma | |
| 6,815,961 | B2 | 11/2004 | Mok et al. | |
| 6,821,129 | B2 | 11/2004 | Tsuchiya | |
| 6,843,659 | B2 | 1/2005 | Liao et al. | |
| 6,847,101 | B2 | 1/2005 | Fjelstad et al. | |
| 6,848,173 | B2 | 2/2005 | Fjelstad et al. | |
| 6,848,929 | B2 | 2/2005 | Ma | |
| 6,853,210 | B1 | 2/2005 | Farnworth et al. | |
| 6,857,880 | B2 | 2/2005 | Ohtsuki et al. | |
| 6,869,290 | B2 | 3/2005 | Brown et al. | |
| 6,881,070 | B2 | 4/2005 | Chiang | |
| 6,887,085 | B2 | 5/2005 | Hirai | |
| 6,916,181 | B2 | 7/2005 | Brown et al. | |
| 6,920,689 | B2 | 7/2005 | Khandros et al. | |
| 6,923,656 | B2 | 8/2005 | Novotny et al. | |
| 6,926,536 | B2 * | 8/2005 | Ochiai | 439/66 |
| 6,957,963 | B2 | 10/2005 | Rathburn | |

| | | | | |
|---|---|---|---|---|
| 6,960,924 | B2 | 11/2005 | Akram | |
| 6,976,888 | B2 | 12/2005 | Shirai et al. | |
| 6,980,017 | B1 | 12/2005 | Farnworth et al. | |
| 6,995,557 | B2 | 2/2006 | Goldfine et al. | |
| 6,995,577 | B2 | 2/2006 | Farnworth et al. | |
| 7,002,362 | B2 | 2/2006 | Farnworth et al. | |
| 7,009,413 | B1 | 3/2006 | Alghouli | |
| 7,021,941 | B1 | 4/2006 | Chuang et al. | |
| 7,025,601 | B2 | 4/2006 | Dittmann | |
| D521,455 | S | 5/2006 | Radza | |
| D521,940 | S | 5/2006 | Radza | |
| 7,048,548 | B2 | 5/2006 | Mathieu et al. | |
| 7,053,482 | B2 | 5/2006 | Cho | |
| D522,461 | S | 6/2006 | Radza | |
| D522,972 | S | 6/2006 | Long et al. | |
| 7,056,131 | B1 | 6/2006 | Williams | |
| D524,756 | S | 7/2006 | Radza | |
| 7,070,419 | B2 | 7/2006 | Brown et al. | |
| 7,083,425 | B2 * | 8/2006 | Chong et al. | 439/66 |
| 7,090,503 | B2 | 8/2006 | Dittmann | |
| 7,113,408 | B2 | 9/2006 | Brown et al. | |
| 7,114,961 | B2 | 10/2006 | Williams | |
| 7,140,883 | B2 * | 11/2006 | Khandros et al. | 439/66 |
| 7,244,125 | B2 | 7/2007 | Brown et al. | |
| 2001/0001080 | A1 | 5/2001 | Eldridge et al. | |
| 2001/0024890 | A1 | 9/2001 | Maruyama et al. | |
| 2002/0008966 | A1 | 1/2002 | Fjelstad et al. | |
| 2002/0011859 | A1 | 1/2002 | Smith | |
| 2002/0055282 | A1 * | 5/2002 | Eldridge et al. | 439/66 |
| 2002/0058356 | A1 | 5/2002 | Oya | |
| 2002/0079120 | A1 | 6/2002 | Eskildsen et al. | |
| 2002/0117330 | A1 | 8/2002 | Eldridge et al. | |
| 2002/0129866 | A1 | 9/2002 | Czebatul et al. | |
| 2002/0129894 | A1 | 9/2002 | Liu et al. | |
| 2002/0133941 | A1 | 9/2002 | Akram et al. | |
| 2002/0146919 | A1 | 10/2002 | Cohn | |
| 2002/0178331 | A1 | 11/2002 | Beardsley et al. | |
| 2003/0000739 | A1 | 1/2003 | Frutschy et al. | |
| 2003/0003779 | A1 | 1/2003 | Rathburn | |
| 2003/0022503 | A1 | 1/2003 | Clements et al. | |
| 2003/0035277 | A1 | 2/2003 | Saputro et al. | |
| 2003/0049951 | A1 | 3/2003 | Eldridge et al. | |
| 2003/0064635 | A1 | 4/2003 | Ochiai | |
| 2003/0089936 | A1 | 5/2003 | McCormack et al. | |
| 2003/0092293 | A1 | 5/2003 | Tomonari | |
| 2003/0096512 | A1 | 5/2003 | Cornell | |
| 2003/0099097 | A1 | 5/2003 | Mok et al. | |
| 2003/0129866 | A1 | 7/2003 | Romano et al. | |
| 2003/0147197 | A1 | 8/2003 | Uriu et al. | |
| 2003/0194832 | A1 | 10/2003 | Lopata et al. | |
| 2004/0029411 | A1 | 2/2004 | Rathburn | |
| 2004/0033717 | A1 | 2/2004 | Peng | |
| 2004/0118603 | A1 | 6/2004 | Chambers | |
| 2004/0127073 | A1 | 7/2004 | Ochiai | |
| 2005/0088193 | A1 | 4/2005 | Haga | |
| 2005/0142900 | A1 | 6/2005 | Boggs et al. | |
| 2005/0167816 | A1 | 8/2005 | Khandros et al. | |
| 2005/0208788 | A1 | 9/2005 | Dittmann | |
| 2005/0287828 | A1 | 12/2005 | Stone et al. | |
| 2006/0028222 | A1 | 2/2006 | Farnworth et al. | |

FOREIGN PATENT DOCUMENTS

| | | | |
|---|---|---|---|
| EP | 0692823 | B1 | 2/2003 |
| EP | 1005086 | B1 | 9/2003 |
| EP | 0839321 | B1 | 1/2006 |
| JP | 2000-114433 | | 4/2000 |
| JP | 2001-203435 | | 7/2001 |
| WO | WO-9602068 | A1 | 1/1996 |
| WO | WO-9743653 | A1 | 11/1997 |
| WO | WO-9744859 | A1 | 11/1997 |
| WO | WO-0213253 | A1 | 2/2002 |
| WO | WO-2005034296 | A1 | 4/2005 |
| WO | WO-2005036940 | A1 | 4/2005 |
| WO | WO-05067361 | | 7/2005 |

OTHER PUBLICATIONS

Mahajan, Ravi et al., "Emerging Directions for packaging Technologies", *Intel Technology Journal*, V. 6, Issue 02, (May 16, 2002),62-75 Pgs.

Williams, John D., "Contact Grid Array System", *Patented Socketing System for the BGA/CSP Technology*, E-tec Interconnect Ltd.,(Jun. 2006),1-4 Pgs.

* cited by examiner 209
208
204'
206
L2
C
C
CL
206
201
204
208
209
Hd ≥ WD

L2
α
210

600
606
610a
610b
208
208
204a
204b
206a
206b
314
314
604
602
606a
606b
612a
612b
608
$W_E$ 204a
204b

CONNECTOR HAVING STAGGERED CONTACT ARCHITECTURE FOR ENHANCED WORKING RANGE

BACKGROUND

1. Field of the Invention

This invention relates to electrical connectors, and in particular to components having arrays of elastic contacts.

2. Background of the Invention

As the need for device performance enhancement in electronic components drives packaging technology to shrink the spacing (or "pitch") between electrical connections (also referred to as "leads"), a need exists to shrink the size of individual connector elements. In particular, packaging that involves advanced interconnect systems, such as interposers, can have large arrays of contacts, where individual electrical contacts in the array of contacts are designed to elastically engage individual electrical contacts located in a separate external device, such as a PCB board, IC chip, or other electrical component.

Although interposers, IC chips, PCB boards and other components are typically fabricated in a substantially planar configuration, often the contacts within a given component do not lie within a common plane. For example, an interposer with contacts arranged in substantially the same plane may be coupled to a PCB that has contacts at various locations on the PCB that have varying height (vertical) with respect to a horizontal plane of the PCB. In order to accommodate the height variation, the interposer contacts can be fabricated with elastic portions that are deformable in a vertical direction over a range of distances that accounts for the anticipated height variation.

As device size shrinks and the amount of components per unit area on electrical components increases, the pitch of contact arrays in interconnect systems such as interposers must be reduced. As used herein, the terms "pitch" or "array pitch" refer to the center-to-center distance of nearest neighbor contacts in an array of contacts, where the distance is typically measured in a direction within a horizontal plane of the contact array. Concomitant with reduction of array pitch is a reduction in average size of the contacts within the array (also termed "array contacts"). This results in a reduction in the dimensions of elastic portions of the contacts, which are typically configured as arms or beams that extend from a base contact in a three dimensional manner above a surface defined by the contact base. This reduction in contact arm length in turn leads to an undesirable reduction in the height variation through which the contact arm can be displaced, and therefore a reduction in height variation of an external component that can be accommodated by the interposer contact array.

2*a* and 2*b* depict, respectively, a contact array and a portion thereof, arranged according to one configuration of the present invention.

Figure 2A:
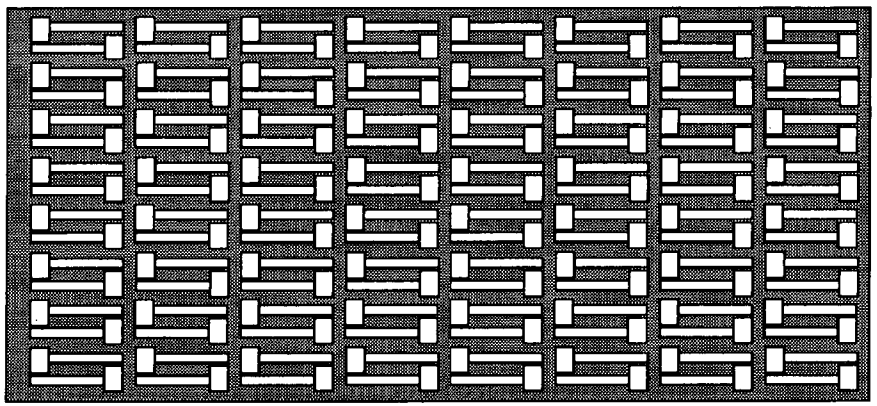
Figure 2B:
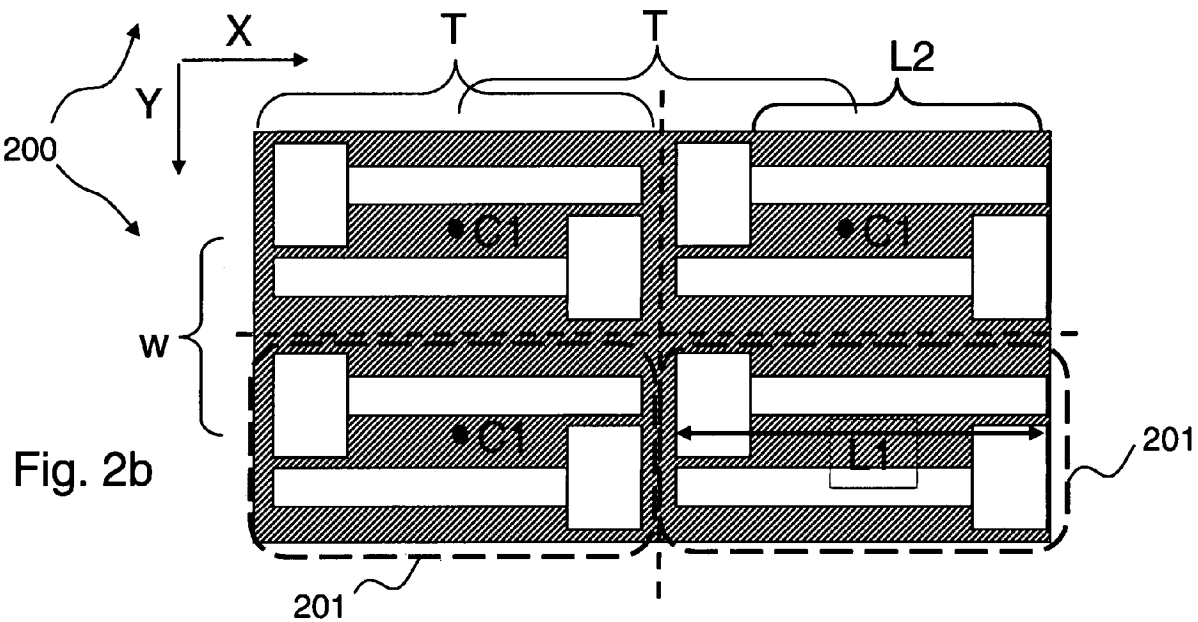
Figures 2C, 2D:
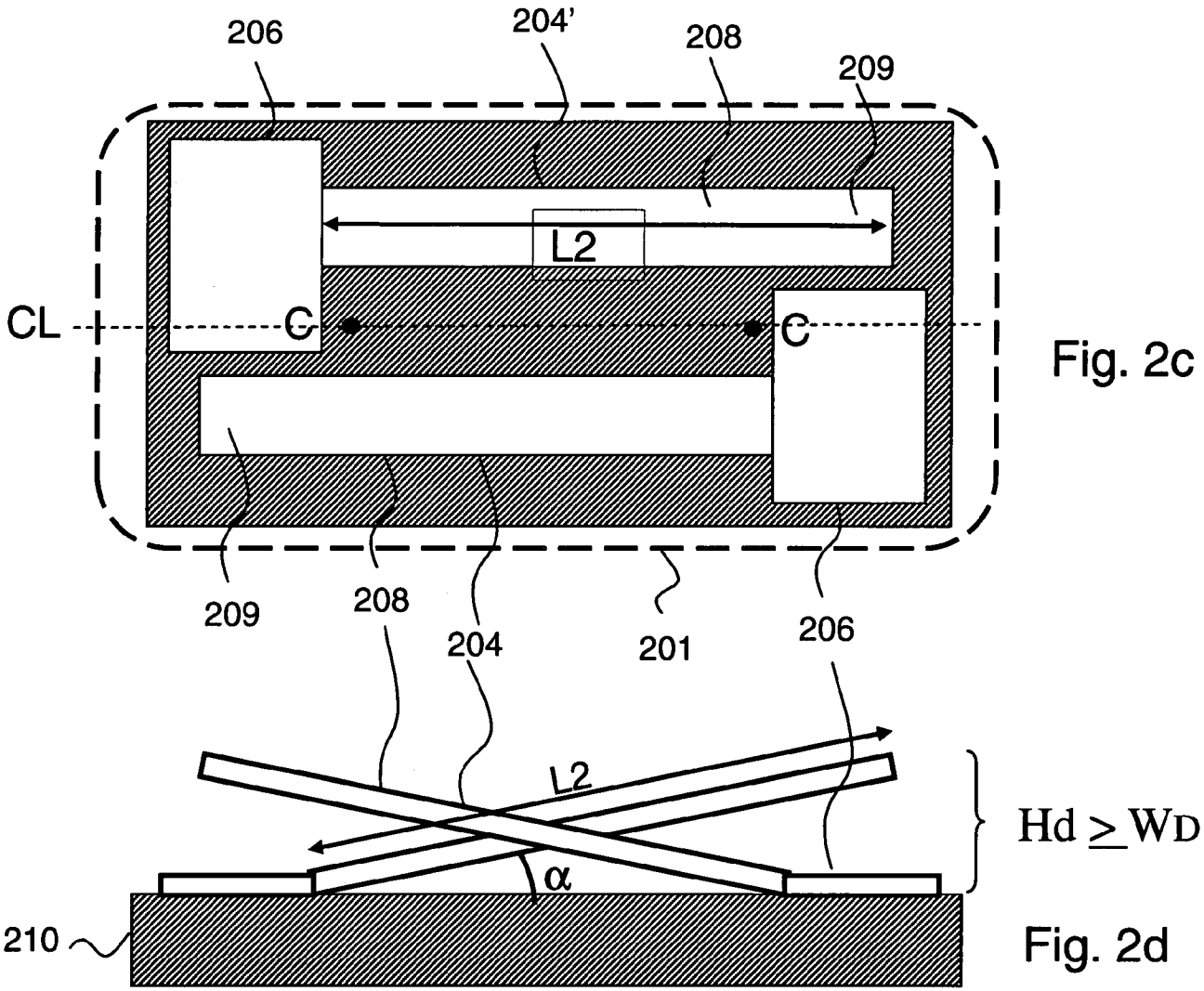

FIGS. 2*c* and 2*d* illustrate a plan view and side view, respectively, of one contact cell of the array of FIG. 2*a*.

Figure 2E:
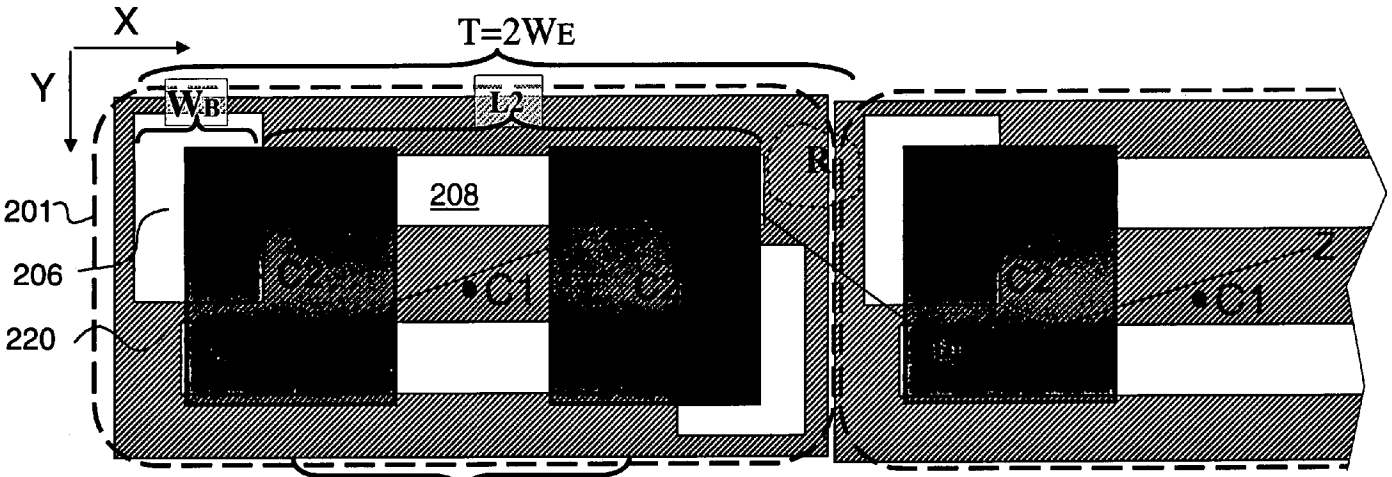

FIG. 2*e* depicts details of one arrangement for aligning an external device contact array with the arrangement of FIG. 2*a*.

Figures 1A, 1B, 1C, 1D:
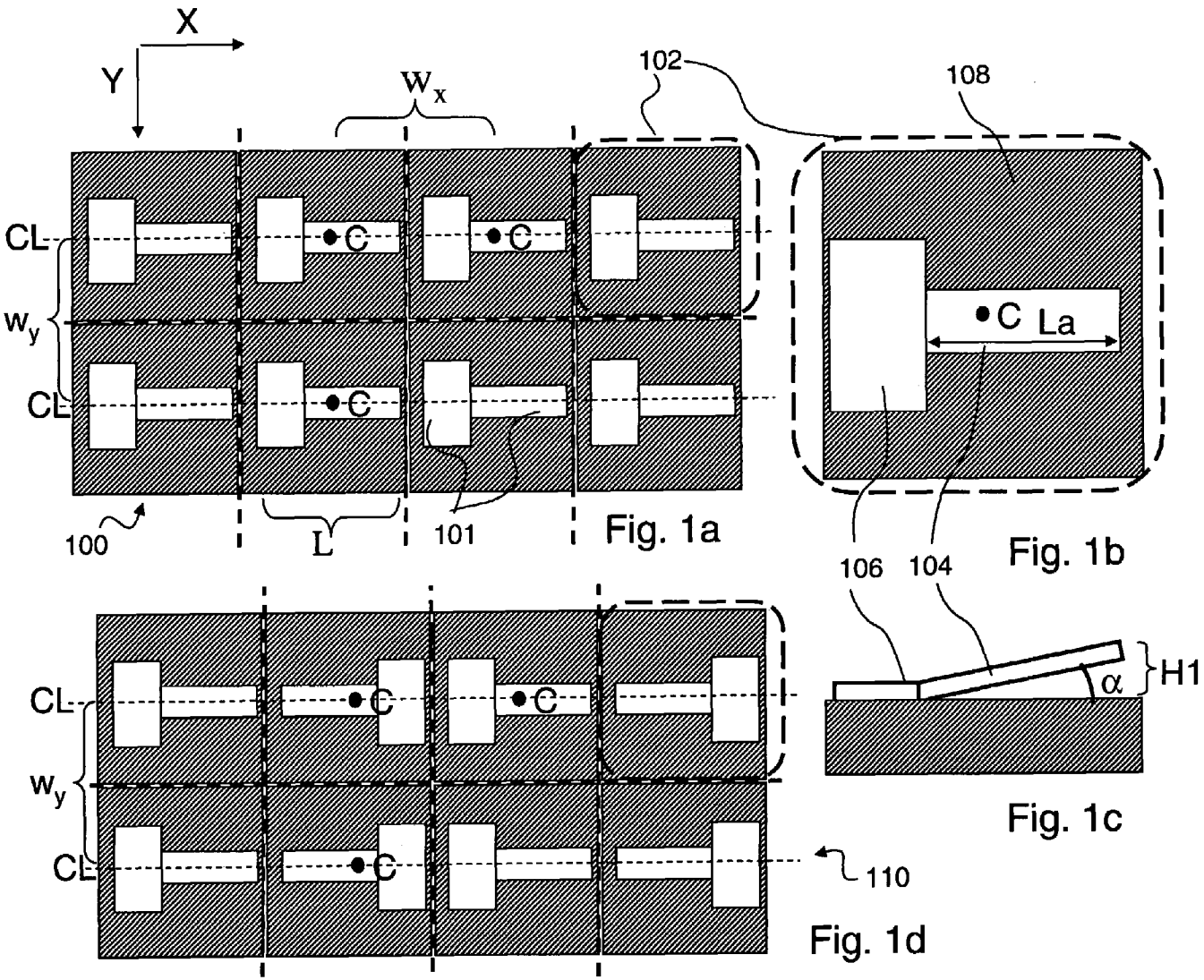
FIGS. 1*a* and 1*d* depict in-line arrangements of elastic contacts.
FIGS. 1*b* and 1*c* depict a plan view and side view, respectively, of a single contact of the arrangement of FIG. 1*a*.
Figure 2F:
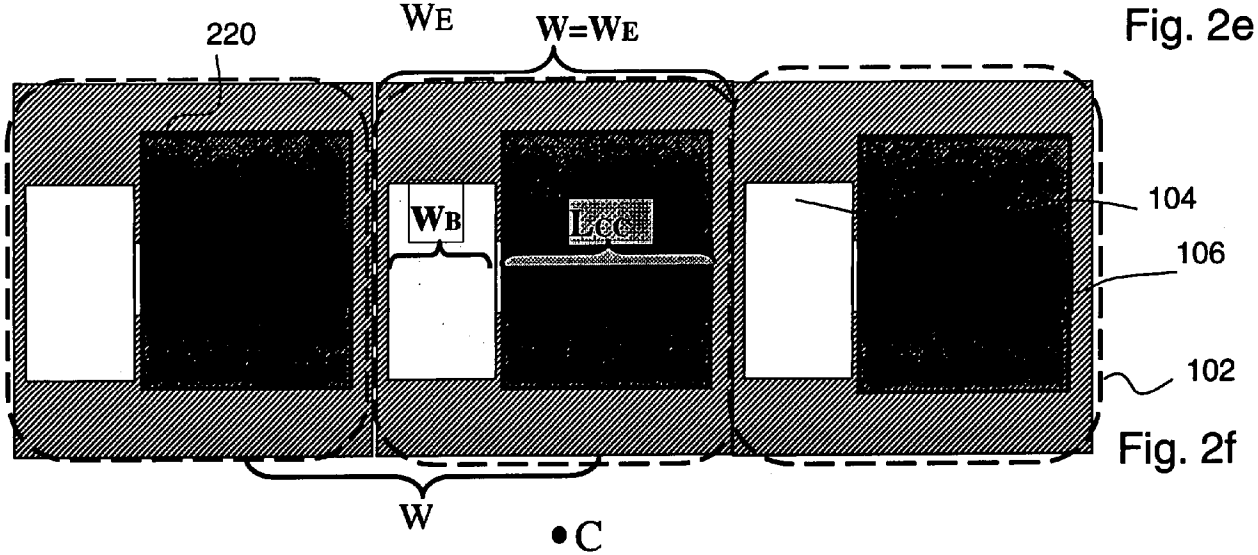

FIG. 2*f* depicts details of an arrangement for aligning the external device contact array of FIG. 2*e* with the reference arrangement of FIG. 1*a*.

Figures 2G, 2H:
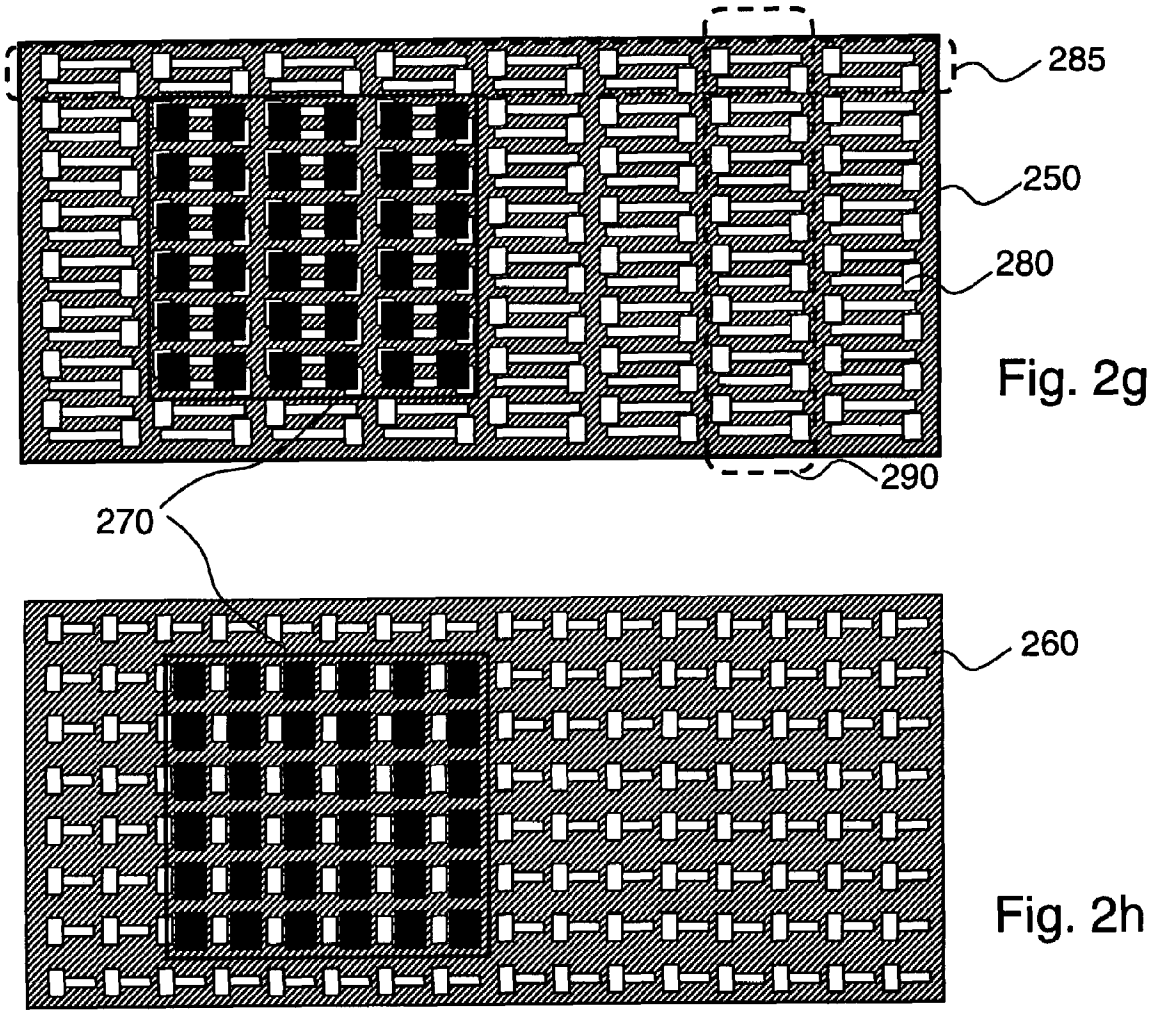

FIGS. 2*g* depicts a connector with contacts arranged according to another configuration of the present invention.

FIG. 2*h* depicts a connector having the reference contact arrangement of FIG. 1*a*.

Figure 3:
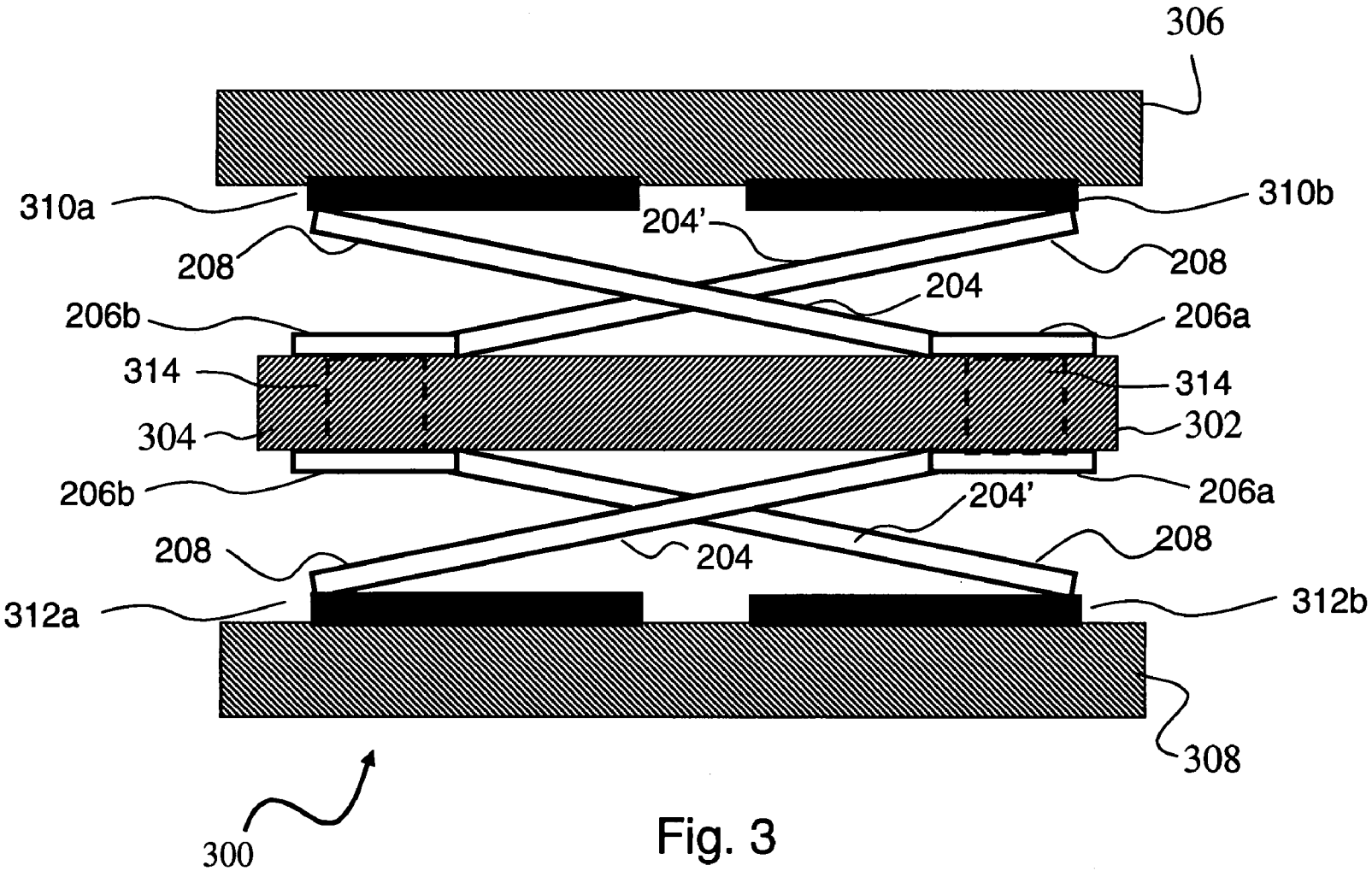

FIG. 3 illustrates the operation of a connector having a double sided contact structure, according to another configuration of the present invention.

Figure 4A:
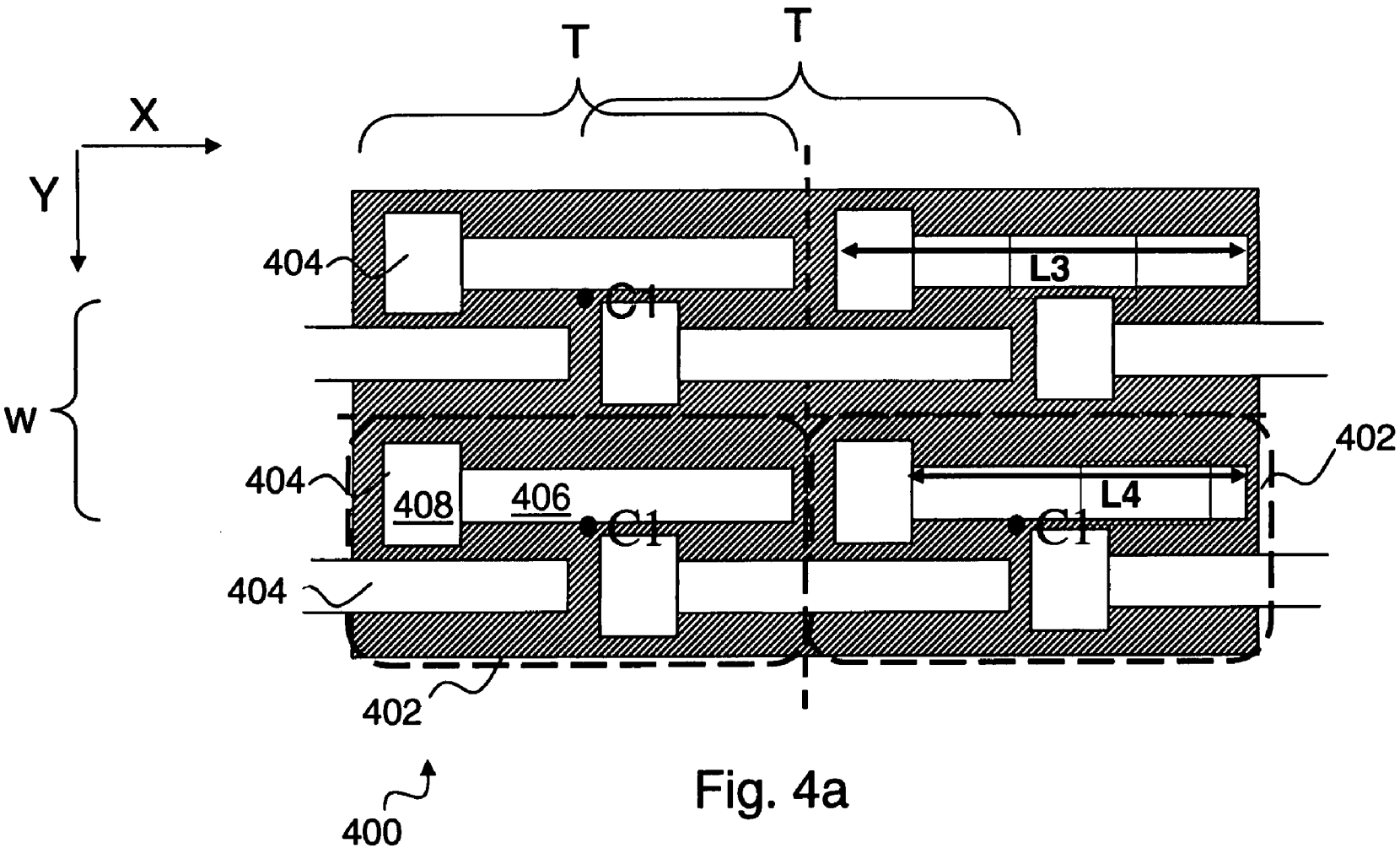

FIG. 4*a* depicts another contact arrangement 400, according to a further configuration of the present invention.

Figure 4B:
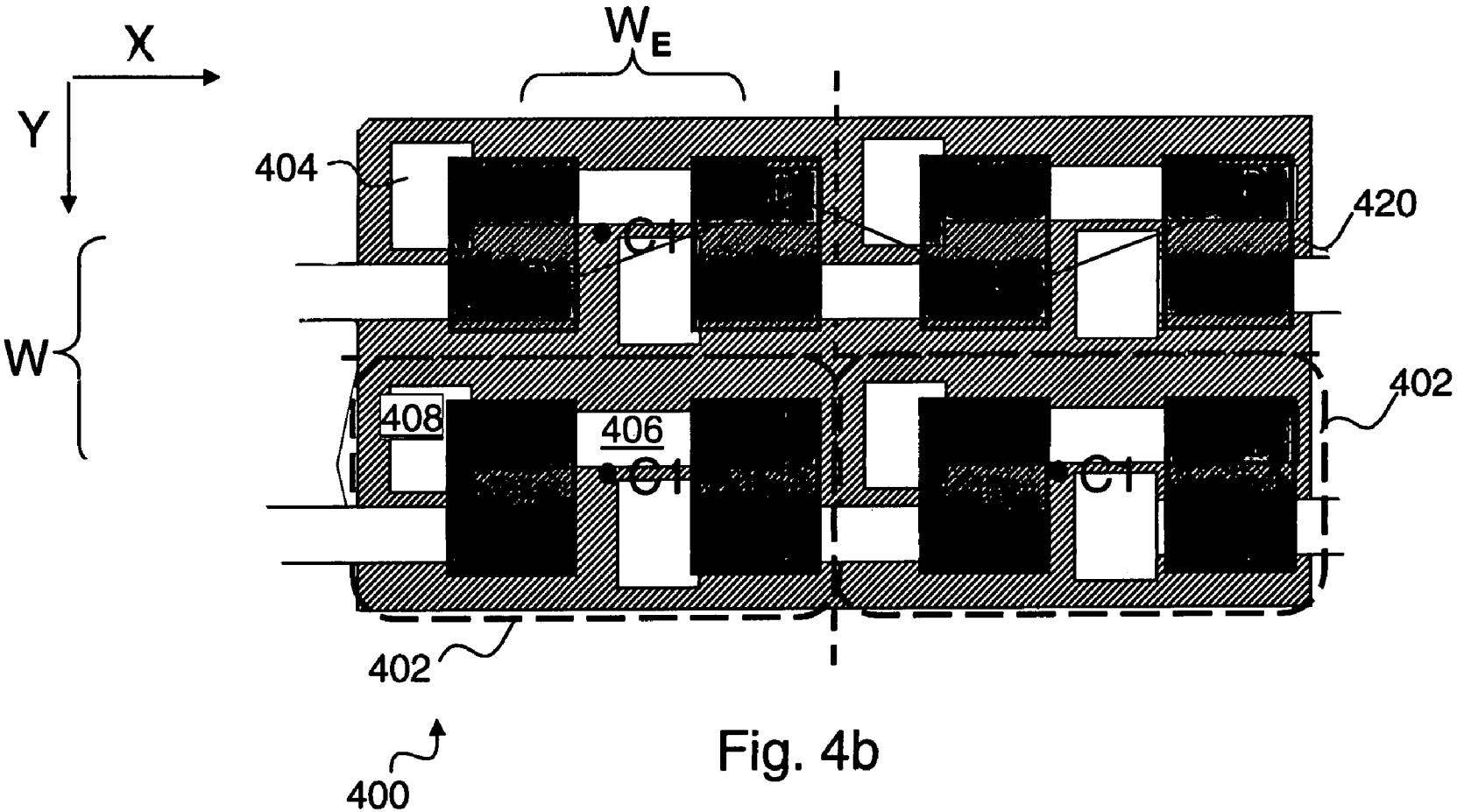

FIG. 4*b* illustrates details of an external contact array and a connector having the contact arrangement of FIG. 4*a*.

Figure 4C:
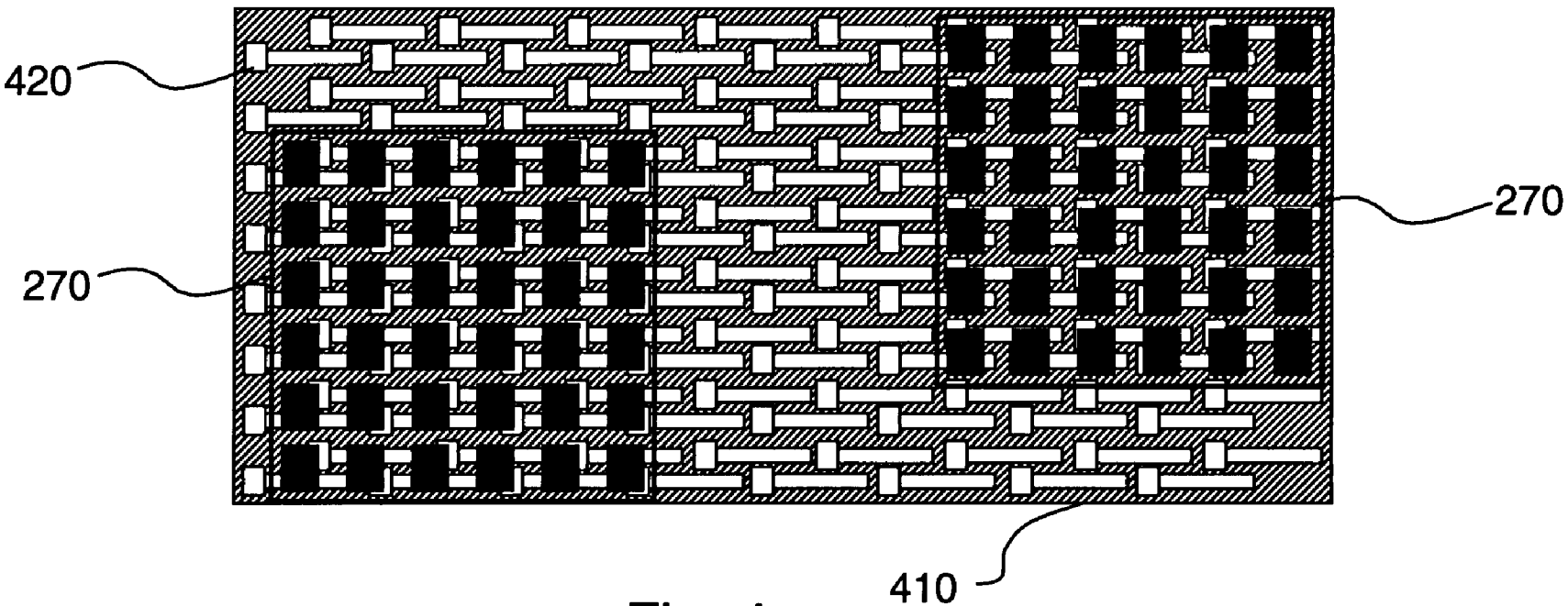

FIG. 4*c* illustrates different placements for an external device having a contact array with respect to a connector designed according to the contact architecture detailed in FIG. 4*a*.

Figure 5A:
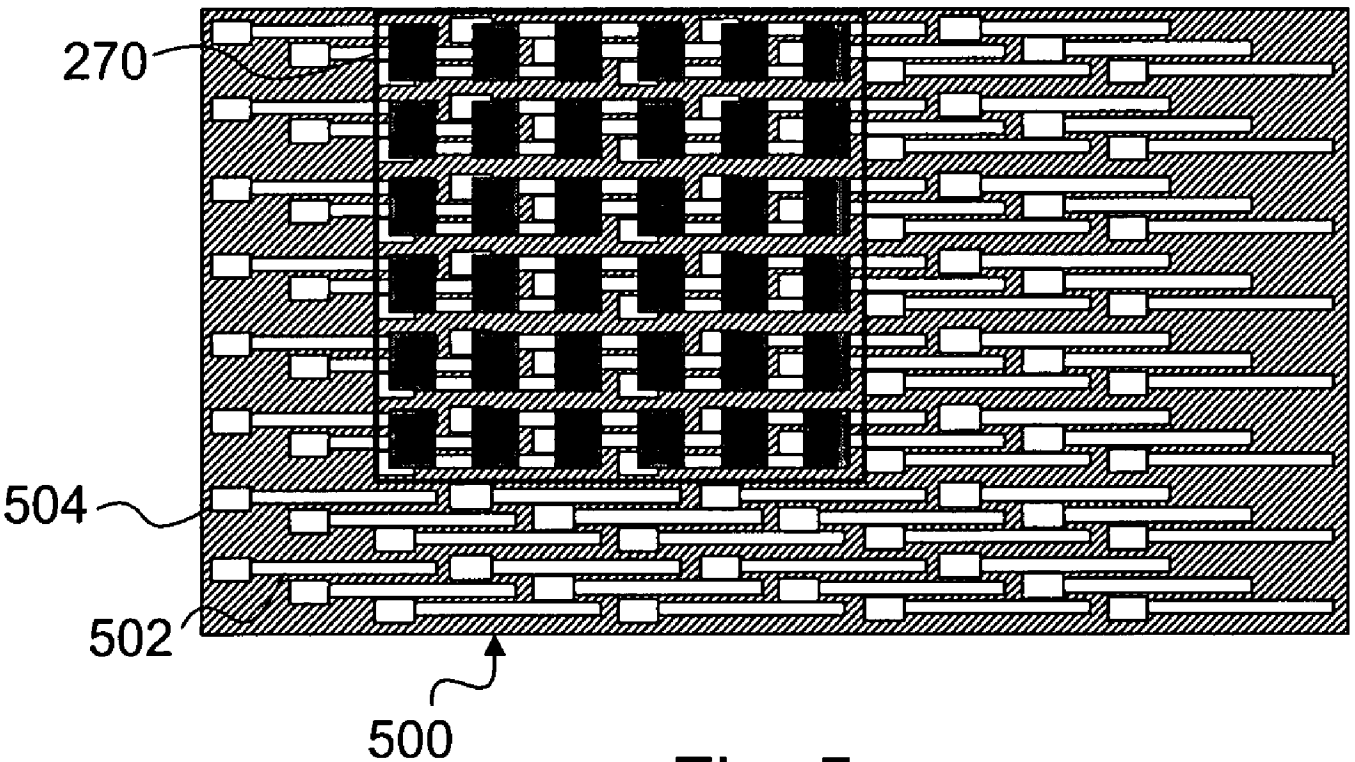
Figure 5B:
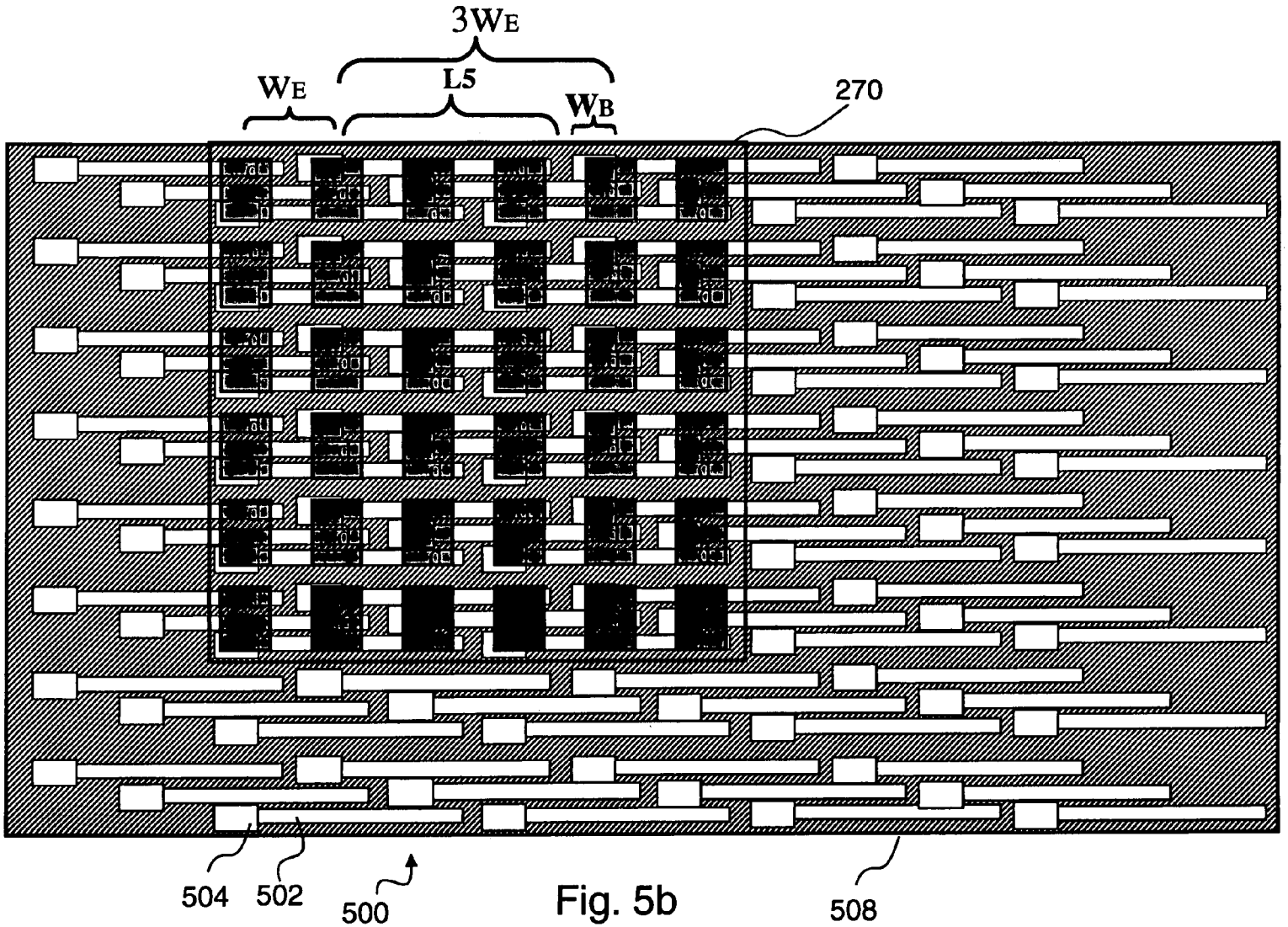

FIGS. 5*a* and 5*b* depict a triple stagger contact architecture, according to one configuration of the present invention.

Figures 6A, 6B:
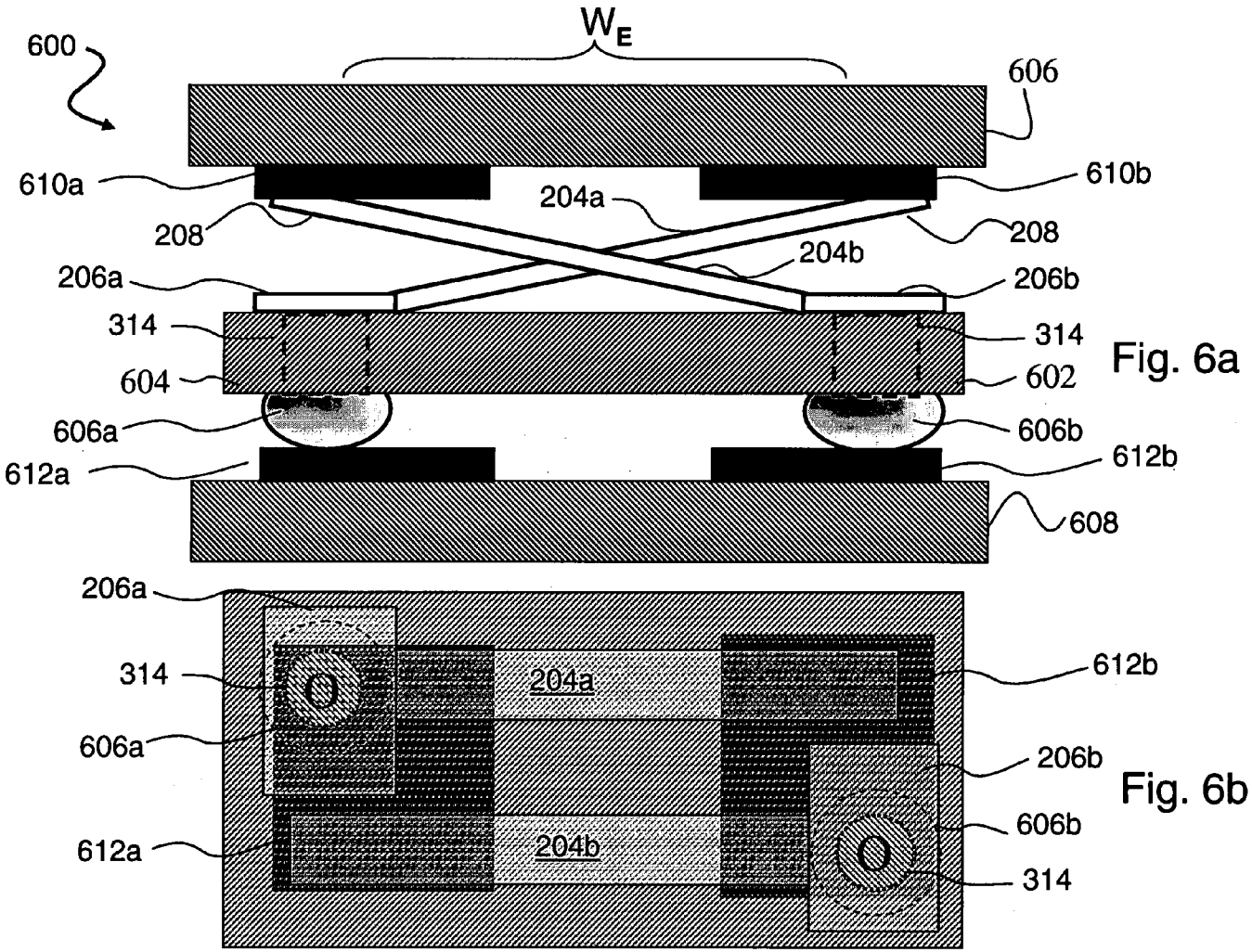

FIGS. 6*a* and 6*b* illustrate a side view and plan view, respectively of a component system arranged in accordance with another configuration of the present invention.

Figure 7:
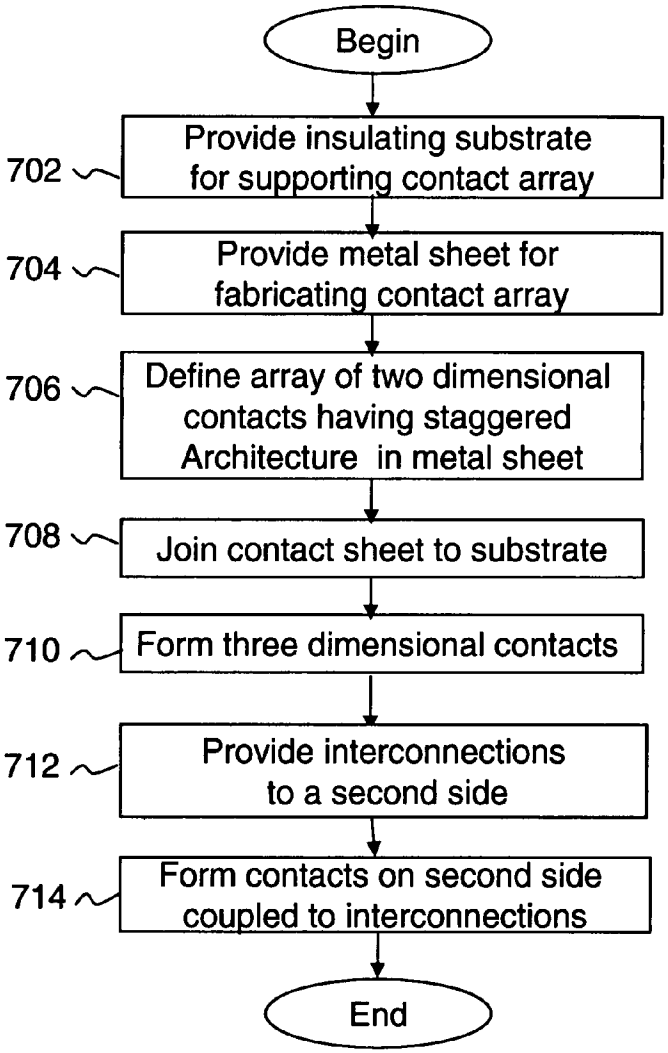

FIG. 7 illustrates a method for forming a connector with enhanced working range, according to one configuration of the present invention.

DETAILED DESCRIPTION

FIG. 1*a* is a reference architecture used to describe the present invention and illustrates an array 100 of contacts 101, each arranged within a contact cell 102, according to an "in-line" architecture. Elastic contact arm 104 extends above a base 106 at an angle α, as shown in FIGS. 1*b* and 1*c*. Contacts 101 are arranged in an X-Y square grid indicated by dashed lines, where the region between adjacent X-gridlines and adjacent Y-gridlines defines a cell. The grid spacing W, that is, the distance between centers (C) of neighboring cells 102, is also termed the array pitch. In this example the grid spacing along the X and Y directions, Wx and Wy, respectively, is represented as equal, but can in general differ. The arrangement, or "architecture," of contacts 101 is a simple design layout in which each contact occupies the same relative position within its respective cell. In the reference arrangement shown in plan view in FIG. 1*a*, contact arms 104 of contacts in adjacent cells project their long axis in the X direction along a common line, which, for convenience, can be chosen at the cell center line CL. Each cell 102 thus has contacts 101 that are symmetrically positioned on both sides of CL. A slight variation on the arrangement of FIG. 1*a* is shown in FIG. 1*d* in which adjacent contacts 101 of array 110 are arranged along a common center line in the X-direction but are flipped in orientation.

In the reference contact arrangements depicted in FIGS. 1*a* and 1*d*, when the array pitch W is reduced in size, for example, at least in the X direction, so that the separation of center points C in adjacent cells becomes smaller, the overall contact length L must be reduced. This entails a reduction in the length La of contact arms 104. In other words, given the "in-line" arrangement of adjacent contacts, where successive contacts along the X-direction are centered on a common line, the contact arm length La must always be substantially smaller than W to allow space for a base portion of the contacts.

In the arrangement shown in FIGS. 1*a*-1*d*, for a given value of α that defines the angle between the elastic arm direction and the plane of base portion 106, the top portion of elastic contact 101 is located at height H1 above substrate 108. H1 represents the approximate distance over which an elastic contact arm 104 can be vertically displaced when it comes into contact with an external contact, such as a signal pin or pad, and is subsequently pushed until it comes to rest aligned with the plane of base portion 106. In cases where an elastic contact arm extends over a hollow via, it would be possible in principle for the arm to be deformed below the plane of the base portion and into the via. But for the purposes of simplification, it will be assumed hereinafter, unless otherwise noted, that the maximum displacement distance for an elastic contact arm is defined by the plane of the contact base portion. Accordingly, when array pitch W is reduced, the concomitant decrease in contact arm length La entails a proportional decrease in this maximum vertical distance H1.

In an extreme case where contact array 100 is designed to contact an external component having contacts at an uneven height, if the height variation between contacts of the external component exceeds H1, this can result in electrical failure. In other words, a connector having contacts with a limited range of vertical displacement H1 cannot electrically engage all the electrical contacts of an external component that lie at different heights, if the variation in heights of external contacts exceeds the ability of different contacts 101 to displace vertically to accommodate the variation. Thus, some contacts 101 will be prevented from coming into contact with an intended external connection. This could result in electrical failure of the system containing contact array 100 and the external component.

Short of electrical failure, the reduction in contact arm length La that occurs with reduced array pitch can lead to an undesirable reduction of working range for the electrical connector containing the array of contacts. As used herein, the term "working range" denotes a range over which a property or group of properties conforms to predetermined criteria. The working range is a range of distance (displacement) through which the deformable contact portion(s) can be mechanically displaced while meeting predetermined performance criteria including, without limitation, physical characteristics such as elasticity and spatial memory, and electrical characteristics such as resistance, impedance, inductance, capacitance and/or elastic behavior. Thus, for example, the vertical range of distance over which all contacts in a connector form low resistance electrical contact with an external component may be reduced to an unacceptable level. In the example of FIG. 1*b*, H1 would generally correspond to an upper limit of working range, assuming that a contact arm 104 that engages an external component at height H1 is not free to travel below a plane of base 106.

Thus, when reducing overall device pitch, a user employing a contact design like that depicted in FIGS. 1*a*-1*d* is presented with a tradeoff between the increased device and circuit densities achieved by scaling down contact pitch W, and the known advantages that adhere thereto, and a reduced ability to accommodate height variations between contact positions when coupling to contacts of external electrical components.

FIG. 2*a* illustrates an arrangement (or "architecture") of a contact array 200 according to one configuration of the invention. As further depicted in FIG. 2*b*, which shows a portion of array 200, the contact architecture can be characterized by an array of rectangular cells 201, each having a separation distance between cell centers (pitch) C1 equal to T in the X-direction and W in the Y-direction. In one configuration of the invention, T=2W. In configurations of the invention, array 200 may contain hundreds or thousands of cells. It will be understood by those of ordinary skill in the art that each cell 201 represents a convenient reference unit of contact array 200 that is repeated along an X-Y grid of the array, and need not have any physical borders that would demarcate one cell from another.

The arrangement of FIG. 2*b* can also be characterized by use of a cell having larger dimensions. For example, the four cells 201 illustrated in FIG. 2*b* could form a larger cell that is repeated over a larger X-Y contact array. However, in the configuration of the invention depicted in FIGS. 2*a* and 2*b*, cells 201 represent the smallest unit for a contact array architecture that is repeated throughout array 200.

FIGS. 2*c* and 2*d* illustrate in plan view and side view, respectively, details of a single cell 201 of the arrangement of FIG. 2*a*. Cell 201 includes two contacts 204, 204,' each having a length L1 and each containing base portions 206 and elastic arm portions 208. In the contact cell architecture of array 200, each contact pair 204, 204' exhibits a stagger between the contacts in the positioning of elastic arms 208, such that the long axis of the elastic arms do not lie along a common line and do not lie along center line CL. The staggered contact architecture depicted in FIGS. 2*a* and 2*b*, and in further configurations described below, facilitates an increase in the long dimension of contact arms for any given array pitch of an external array of contacts to be engaged. The terms "staggered contacts" or "staggered contact architecture" as used herein, refer to an arrangement in which a line connecting distal portions of the contact arms of successive contacts forms a staggered pattern (see, for example, line Z of FIG. 2*e*).

In the configuration depicted in FIGS. 2*c* and 2*d*, contacts 204 and 204' each have a contact arm length L2 and are essentially identical except that their mutual orientation is substantially opposite to each other. This opposed pair architecture is characterized by the following features:

A) a common axis defining a long direction of the contacts, in this case along the X-direction;

B) base portions 206 of respective contacts 204, 204' are located towards outer regions at mutually opposite ends of cell 201 as viewed along the X-direction; and C) distal end portions 209 of beams (elastic arms) 208 of respective contacts 204, 204' extend above substrate 210 away from base portions 206 and towards mutually opposite ends of cell 201 as viewed along the X-direction.

Thus, elastic contact arm 208 of contact 204 extends in a substantially opposite direction from its base 206 in comparison to its counterpart contact arm of contact 204'.

It is to be understood that the actual physical contact arm length L2, as depicted in FIG. 2*d* exceeds the projected contact arm length, that is, the apparent contact arm length of contacts 204, 204' as it appears in plan view. However, for purposes of simplicity, the label L2 is used to denote the true physical contact arm length both in side view and plan view representations.

In comparison to the in-line contact design of FIG. 1, in the staggered contact architecture exhibited by the pairs of opposed contacts 204, 204' depicted in FIGS. 2*c* and 2*d*, over, the contact arm length L2 can exceed $W_E$ the contact array pitch of an external component to be contacted, as illustrated in FIG. 2*e*. In the staggered architecture, when viewed along the X direction, contact 204 overlaps its opposed partner contact 204' along nearly the entire length. However, physical overlap is prevented by the stagger in positions of the contacts with respect to centerline CL shown in FIG. 2*c*. This allows the contact working distance for contacts 204, 204' to be increased, as discussed further below.

As depicted in FIG. 2*d*, contacts 204, 204' are attached at base portions 206 to insulating substrate 210. Substrate 210 and contacts 204, 204' can form part of an interposer, a land grid array, a ball grid array, or other electrical connectors that include arrays of contacts. Referring again to FIG. 2*b*, the cell width along the X-direction (T) is equivalent to the separation of cell centers. In the case where T=2W, the length L2 of elastic arms 208 can be much longer than a corresponding length of the contact arms of contacts 101 illustrated in FIG. 1*a*. Accordingly, for a given angle α, the height Hd (FIG. 2*d*), is also much larger than the corresponding height H1 for the shorter contact arms 104 of the reference, non-staggered, contact architecture shown in FIGS. 1*a-c*. Height Hd, in turn, represents an upper limit on working distance WD for contact arms 204, 204'. Thus, working distance of contacts arranged according to the architecture of FIGS. 2*a*-2*d* is substantially greater than that of in-line contacts 101. Any connector containing a contact array fabricated according to the architecture of FIG. 2*a* can thus have a larger working distance than a connector made having the reference contact arrangement depicted in FIG. 1*a*.

FIGS. 2*e* and 2*f* further compare details of the contact architecture of the configuration depicted in FIG. 2*c*, and the reference contact architecture depicted in FIG. 1*a*. In each case, an array of external device contacts 220, having a pitch W, is shown projected over the respective contacts. In particular, FIG. 2*e* depicts details of one possibility for aligning an external device contact array with the contact arrangement of FIG. 2*a*. FIG. 2*f* depicts one manner of aligning the same array of external device contacts 220 of FIG. 2*e* with the reference contact array structure of FIG. 1*a*. In this case, only a portion of a row of external contacts 220 positioned in a line along the X-direction is shown.

As a comparison of FIGS. 2*e* and 2*f* illustrates, for both architectures, every external device contact 220 is engaged by a single contact arm from a respective elastic contact. Thus, the architecture of array 200 of this invention, as well as reference contact arrangement 100, provides contact arrays capable of contacting every contact of an external device having an array pitch of W. However, in the architecture of array 200 of the present invention, the contacts are capable of much greater vertical displacement (Hd) than that of their counterparts in arrangement 100 (H1). In configurations of the invention, as suggested by comparison of FIGS. 1*c* and 2*c*, displacement Hd may be more than twice displacement H1. This is because the staggered contact architecture provides the ability of the contact arm length L2 to exceed $W_E$.

The staggered contact architecture allows adjacent contacts 220 positioned along the X-direction to be contacted by the pair of staggered contacts 204, 204' that are arranged side-by-side with respect to the X-direction. This, in turn, results in a staggered pattern of coupling between contacts 204, 204' and 220, where a path drawn between the areas of contact D in successive contacts 220 traces out a zigzag pattern Z (FIG. 2*e*) instead of a straight line in the reference contact arrangement (FIG. 2*f*). Thus, although the contact cell pitch T of array 200 along the X-direction is twice the pitch (W) of the external contact array of contacts 220, and the contact arm length L2 exceeds W, by staggering contacts 204, 204' in array 200, the array of external contacts 220 is completely accessible, that is, each external contact 220 can be contacted by a contact of array 200 along the X-direction. In this manner, the effective array pitch in the X-direction for contacts 206 is $W_E$ which is the same as array pitch W of in-line contacts 104. The term "effective array pitch" refers to a spacing along the long direction of elastic contacts equal to the distance between neighboring contacts in an external contact array that is completely accessible to the elastic contacts.

In general, the stagger architecture of contacts 204, 204' along the X-direction permits contact to be made at successive external contacts along the X-direction, where the external contact pitch W is much smaller than the contact arm length L, a result not possible in the in-line architecture of FIG. 1*a*. Thus, as illustrated in FIG. 2*e*, the contact arm length L2 can substantially exceed the effective array pitch $W_E$ (which is equivalent to W). For example, in FIG. 2*e*, L2 is about 60% greater than $W_E$, and in other configurations could be extended over nearly the entire region R, such that the upper limit on contact length L2 is about two times $W_E$ minus the base width $W_B$ or $L2=2W_E-W_B$. Thus, if $W_B$ is reduced, L2 can approach $2W_E$. This contrasts to the in-line contact arrangement of FIG. 2*f* in which the contact arm length Lcc of contacts 104 is limited to being less than the value of W ($W_E$) by an amount at least equal to the contact base width, or $L_{CC}=W_E-W_B$. Thus, since $W_B$ must have finite dimensions, L2 can be more than double Lcc. In other words, it is always true that $2W_E-W_B>2(W_E-W_B)$.

Thus, in comparison to the in-line arrangement depicted in FIGS. 1*a-c* and FIG. 2*f*, the configuration illustrated in FIG. 2*e* provides a manner of increasing the elastic contact displacement range H (and therefore working distance) for a given pitch W of an external device to be contacted. This can be expressed as a normalized working range N, where N=H/W (where H is initial contact height above a substrate for a given arrangement). In the invention configuration illustrated above, N may be more than double that of contacts arranged according to the in-line contact arm arrangement of FIG. 2*f*.

FIGS. 2*g* and 2*h* depict a connector 250 with contacts 280 arranged according to one configuration of the present invention and a conventional connector 260, respectively. Connector 250 includes a plurality of rows 285, where each row includes a plurality of contact pairs that make up a cell 201, as depicted in FIG. 2*c*. Connector 250 also includes a plurality of columns 290, where each column also includes a plurality of cells 201. Each connector 250, 260 (shown in contact with a 6×6 array 270 of external contacts) is capable of contacting a 16×8 X-Y array of contacts placed on a square grid. The contact array of connector 250 is only 8 contacts "wide" when viewed along the X-direction, while it is 16 contacts wide when viewed along the Y-direction.

In one configuration of the invention, contacts 204 are fabricated using a lithographic process to define and pattern contact elements from a metallic layer (not shown). The contacts are "formed" into three dimensions, such that contact arms 208 extend above the plane of base portion 206, by means of pressing the metallic layer over a set of configurable die. In one configuration, the forming process takes place after metallic contact structures are defined in two dimensions. Details of the contact fabrication process are disclosed in U.S. patent application Ser. No. 11/083,031, filed Mar. 18, 2005, which is incorporated in its entirety herein.

FIG. 3 illustrates a side view of a portion of component system 300 arranged in accordance with another configuration of the present invention. As illustrated, two sets of opposed contacts 204, 204' that mirror each other are disposed on opposite sides of insulating substrate 304 of connector 302. The distal portion of elastic arm 208 of each contact engages a contact pad 310 or 312 of respective electrical components 306 and 308, which are disposed on opposite sides of connector 302. In one configuration, a pair of contact base portions 206*a* (and 206*b*) associated with contacts disposed on opposite sides of substrate 304, are electrically interconnected by conductive vias 314 formed through substrate 304. In this manner, pads 310*a* and 312*a* are electrically connected to each other, and pad 310*b* is electrically connected to pad 312*b*. Thus, for components 306 and 308, contacts that have the same relative position (as determined within an X-Y grid within the plane of a respective component) can be electrically coupled using connector 302.

FIG. 4*a* depicts another contact architecture associated with array 400, according to a further configuration of the present invention. In one example, cells 402 can have substantially the same dimensions as cells 201 of FIG. 2*b*. Cells 402 each contain a full contact 404 and portions of two other contacts 404. In this case, distal portions of an elastic contact arms 406 of each contact are located on the same side of the respective base portion 408 of the contact. Each cell 402 contains two contact base portions 408 that are staggered with respect to a cell center line drawn in the X-direction (not shown). Because of this, the overall length projected contact length L3 and contact arm length L4 of contacts 404 can be about the same as that of contact arms 208 of FIG. 2*b*. The difference between arrays 200 and 400 is that array 200 includes staggered contacts in which pairs of contacts 204, 204' have opposing orientations, whereas contacts 404 of array 400 exhibit an "aligned" architecture, that is, all contacts have the same relative positions of base and elastic arm. The contact architecture of FIG. 4*a* can be further characterized as a double aligned architecture, meaning that every second contact along the Y-direction occupies the same position within a cell.

FIG. 4*b* illustrates details of contacting geometry when connector 410, containing the contact arrangement 400, is brought into contact with a square array of contacts 420 located in an external device (not shown for clarity of viewing). Distal portions of contact arms 406, which extend above a plane that contains base portions 408, make contact with contacts 420 at positions marked D. The pattern of D positions in FIG. 4*b* is substantially the same as that for contact array 200 illustrated in FIG. 2*e*.

FIG. 4*c* illustrates how a device component 270 having a square array of contacts can be placed on connector 410. As in the configuration of the invention depicted in FIG. 2*g*, contacts from connector 410 are provided for contacting every contact 420. Connector 410 can be characterized as a connector capable of contacting a 16×8 X-Y array of contacts placed on a square grid such as that contained by 6×6 component 270.

In another configuration of the present invention shown in FIGS. 5*a* and 5*b*, connector 500 has a triple stagger arrangement of contacts that facilitates contacting every contact of device component 270, while providing a much longer elastic contact arm portion 502 for contacts 504. The architecture of connector 500 can be characterized as a triple aligned architecture, denoting that all contacts have the same relative position of their base and elastic arm, and every third contact in the Y-direction occupies the same relative position in the X-direction. As compared to the double stagger contact architecture discussed above, the triple stagger architecture facilitates a further increase in contact arm length relative to effective array pitch. As illustrated in FIG. 5*b*, contact arm length L5 can approach a value of $3W_E$ minus base width $W_B$. For the same reasons noted above in reference to the double stagger architecture, this means that for any given effective array pitch $W_E$, the contact arm length L5 can exceed an in-line contact arm length by a factor of more than three. In other words, it is always true that $3W_E-W_B>3(W_E-W_B)$. Normalized working range can be increased similarly in comparison to in-line contact architecture.

FIG. 6*a* illustrates a component system 600 arranged in accordance with another configuration of the present invention. In this case, the region of connector 602 depicted includes a pair of opposing elastic contacts 204*a*, 204*b* disposed on one side of connector 602, and a pair of ball type connectors 606*a*, 606*b* disposed on the opposite side of connector 602. Contacts 204*a*, 204*b* are electrically connected to respective contacts 606*a*, 606*b* through vias 314. Base portions 206*a* and 206*b* lie directly above respective contacts 606*a* and 606*b*. Accordingly, when connector 602 engages external components 606, 608 disposed on opposite sides of the connector, an electrical path is established between contact pads 610*a* and 612*b*, and also between 610*b* and 612*a*. Ball contacts 606*a*, 606*b* are localized to their respective vias 314, that is, they do not extend laterally away from vias 314, as do contacts 204*a*, 204*b*, but rather, the ball contacts engage external contacts that lie directly below the respective via. From a plan view perspective, this means that ball contacts 606*a*, 606*b*, respective external contacts 612*a*, 612*b*, and vias 314 all have a common overlap region O, as illustrated in FIG. 6*b*. Thus, an electrical connection is established between contact pads in the external components 606, 608 whose lateral position is offset with respect to each other, equivalent to the spacing or pitch ($W_E$) Of the contact arrays of the devices in question.

In the configurations of the invention disclosed above, an enhanced elastic contact arm displacement range Hd is accomplished for connectors used to contact arrays of external components having a separation $W_E$ of nearest neighbor contacts in the array. This can be characterized by comparing the ratio of Hd to effective array pitch $W_E$, which represents the minimum array pitch of an external array of contacts that can be fully contacted by the connector contact array. The vertical displacement achievable by an elastic contact, Hd, can also be characterized by a working range, as discussed above. For a given connector having elastic contacts, the normalized working range N will have an upper limit defined by Hd, divided by $W_E$.

According to configurations of the present invention, N for a substantially linearly shaped elastic arm contact can be increased by more than a factor of three for triple stagger arrangements, and more than a factor of two for double stagger arrangements in comparison to that achieved by an in-line contact array arrangement. This is because as discussed above the contact arm length for a given array pitch can be more than double and more than triple in-line contact arm length using double stagger and triple stagger architectures, respectively. As one of ordinary skill in the art would appreciate, other configurations of the invention are possible having arrangements of staggered contacts different from those disclosed above.

FIG. 7 illustrates a method for forming a connector with enhanced working range, according to one configuration of the invention. In step 702, an insulating substrate is provided to support contacts in the connector.

In step 704, a metallic sheet material is provided from which to form metallic contacts to be used in the connector. The metallic sheet preferably is a material that has reasonable elastic properties.

In step 706, an array of two dimensional contacts is defined in the metallic sheet. This can be accomplished by lithographic and etching techniques that etch metallic shapes in the sheet such as the general features in contacts 204 depicted in plan view in FIG. 2*c*. The relative arrangement of two dimensional contacts in the contact array can be in any of the exemplary architectures of the invention depicted above.

In step 708, the contact sheet is bonded to the insulating substrate.

In step 710, contacts are formed in three dimensions by deforming contact arm portions of the contact to extend above the plane of contact base portions, as depicted in FIG. 2*d*.

In step 712, interconnections are provided in the substrate to electrically connect base portions of the contacts disposed on one side of the substrate to an opposite side of the substrate. The interconnects can be vias or other traces.

In step 714, contacts are formed on the opposite side of the substrate and connected to the interconnects, so that electrical connection can be made from the contacts on the first side of the substrate to the opposite side. At least the contacts disposed on the first side of the substrate exhibit an enhanced normalized working range so that the connector exhibits this property when coupling to one or more external components.

The foregoing disclosure of configurations of the present invention has been presented for purposes of illustration and description. It is not intended to be exhaustive or to limit the invention to the precise forms disclosed. Many variations and modifications of the configurations described herein will be apparent to one of ordinary skill in the art in light of the above disclosure. For example, the scope of this invention includes contacts having contact arms with convex or concave curvature with respect to the plane of the contact base. In other variations, the contact arms may be tapered along their length as viewed from the top or as viewed from the side. Additionally, the invention covers connectors having combinations of different contact arrays, for example, those depicted in FIGS. 4*c* and 5*a*.

In addition, although embodiments disclosed above are directed toward arrangements where the contact dimensions are uniform between different contacts, other embodiments are possible in which contact size varies between contacts. Moreover, embodiments in which each contact "arm" comprises a plurality of contact arms are contemplated. The scope of the invention is to be defined only by the claims appended hereto, and by their equivalents.

Further, in describing representative configurations of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A connector comprising:

an insulating substrate;

an array of staggered contacts disposed on the insulating substrate, each contact comprising a base and an elastic contact arm, the base attached to the insulating substrate, the elastic contact arm projecting above the insulating substrate, the longitudinal axis of the elastic contact arm extending along a first direction, the array of staggered contacts configured to engage an external array in a staggered pattern along the first direction, and the elastic contact arm length is greater than $1.5W_E-W_B$ and no greater than $2W_E-W_B$, where $W_E$ is the effective array pitch and $W_B$ is the width of the base along the first direction.

2. The connector of claim 1, the array of staggered contacts further comprising a double aligned architecture of contacts.

3. In the connector of claim 1, the array of staggered contacts further comprising pairs of opposed contacts.

4. In the connector of claim 3, each pair of opposed contacts further comprising:

base portions of respective contacts of the pair of contacts that are located towards opposite ends of the respective contacts; and elastic arms of respective contacts of the pair of contacts, each elastic arm having a distal end portion extending from its respective base portion above the substrate in an opposite direction to its counterpart.

5. In the connector of claim 3, the array of staggered contacts further comprising a two-dimensional array of contacts having a plurality of rows of opposed contact pairs.

6. In the connector of claim 3, each contact of the array of staggered contacts configured to engage an external contact in an external contact array.

7. In the connector of claim 6, the normalized working range of each contact is greater than a normalized working range of contacts in an in-line contact arrangement with an effective array pitch equal to $W_E$.

8. In the connector of claim 7, the normalized working range is more than double the normalized working range of the contacts having the in-line contact arrangement.

9. The connector of claim 3, the insulating substrate further comprising:

a first side that supports the array of staggered contacts;

a set of conductive vias disposed within the insulating substrate, each via connected to a contact of the array of staggered contacts; and a second side having a second array of staggered contacts, each contact of the second array of staggered contacts electrically coupled through a conductive via of the set of conductive vias to a respective contact of the array of staggered contacts, the connector providing electrical connection between a first set of external contacts and a second set of external contacts disposed on opposite sides of the connector.

10. The connector of claim 9, the array of staggered contacts further comprising a first array of staggered contacts, the second array and first array of staggered contacts mirroring each other.

11. The connector of claim 9, the second array of staggered contacts further comprising contacts localized to their respective conductive vias, the localized contacts forming an overlap region in plan view with the conductive vias and the second set of external contacts.

12. A connector, comprising:

an insulating substrate;

an array of staggered contacts disposed on the insulating substrate, each contact comprising a base and an elastic contact arm, the base attached to the insulating substrate, the elastic contact arm projecting above the insulating substrate, the longitudinal axis of the elastic contact arm extending along a first direction, the array of staggered contacts configured to engage an external array along the first direction in a staggered pattern comprising one of a double stagger and a triple stagger pattern, and the contact arm length of each contact of the array of staggered contacts is greater than $1.5W_E-W_B$ and no greater than $3W_E-W_B$, where $W_E$ is the effective array pitch and $W_B$ is the width of the base along the first direction.

13. A connector comprising:

an insulating substrate;

an array of staggered contacts disposed on the insulating substrate, each contact comprising a base and an elastic contact arm, the base attached to the insulating substrate, the elastic contact arm projecting above the insulating substrate, the longitudinal axis of the elastic contact arm extending along a first direction, the array of staggered contacts configured to engage an external array in a staggered pattern along the first direction, and the elastic contact arm length is greater than $W_E-W_B$ and no greater than $2W_E-W_B$, where $W_E$ is the effective array pitch and $W_B$ is the width of the base along the first direction;

the array of staggered contacts further comprising pairs of opposed contacts; and the insulating substrate further comprising a first side that supports the array of staggered contacts, a set of conductive vias disposed within the insulating substrate, each via connected to a contact of the array of staggered contacts, and a second side having a second array of staggered contacts, each contact of the second array of staggered contacts electrically coupled through a conductive via of the set of conductive vias to a respective contact of the array of staggered contacts.

14. The connector of claim 13, the array of staggered contacts further comprising a first array of staggered contacts, and the second array and first array of staggered contacts mirroring each other.

15. The connector of claim 13, the second array of staggered contacts further comprising contacts localized to their respective conductive vias, the localized contacts forming an overlap region in plan view with the conductive vias and the second set of external contacts.

16. A component system, comprising:

an array of staggered contacts on a first side of a connector;

an external component including an external contact array coupled to at least some of the staggered contacts, the effective array pitch ($W_E$) of the staggered contacts is equivalent to the external array pitch, the staggered contacts arranged to engage the external array in a staggered pattern, and the normalized working range of the staggered contacts is greater than in-line contacts having an equivalent $W_E$;

an array of contacts on a second side of the connector;

a second external component comprising a second external contact array, coupled to at least some of the contacts of the array of contacts on the second side of the connector;

a set of conductive vias electrically interconnecting staggered contacts on the first side and contacts on the second side, at least one of the contacts of the first and second external contact array are electrically connected; and the array of staggered contacts further comprising a first plurality of pairs of opposed contacts, and the array of contacts comprising a second plurality of pairs of opposed contacts disposed on an opposite side of the connector to the first plurality of pairs of opposed contacts, each via connected to a base portion of the first plurality and second plurality of pairs of opposed contacts, and each elastic contact arm extending in the same direction to other elastic contact arms.

17. The component system of claim 16, the array of staggered contacts and the array of contacts both exhibiting an increased normalized working range compared to in-line contact arrays with the same $W_E$.

18. The component system of claim 17, the contact arm length equal to $2W_E-W_B$.

19. A connector, comprising:

an insulating substrate;

an array of staggered contacts disposed on the insulating substrate, each contact comprising a base and an elastic contact arm, the base attached to the insulating substrate, the elastic contact arm projecting above the insulating substrate, the longitudinal axis of the elastic contact arm extending along a first direction, the array of staggered contacts configured to engage an external array along the first direction in an n-staggered pattern, and the contact arm length of each contact of the array of staggered contacts is greater than $1.5W_E-W_B$ and no greater than $nW_E-W_B$, where $W_E$ is the effective array pitch and $W_B$ is the width of the base along the first direction.

* * * * *